United States Patent [19]

Aoki et al.

[11] Patent Number: 4,933,253

[45] Date of Patent: Jun. 12, 1990

[54] ELECTROPHOTOGRAPHIC DEVELOPER COMPRISING TONER PARTICLES AND ACRYLIC POLYMER FINE PARTICLES

[75] Inventors: Takayoshi Aoki; Yukihiro Ishii; Koichi Tanaka; Shigeru Sadamatsu, all of Kanagawa, Japan

[73] Assignee: Fuji Xerox Co., Ltd., Tokyo, Japan

[21] Appl. No.: 708,903

[22] Filed: Mar. 6, 1985

[30] Foreign Application Priority Data

| | | | |
|---|---|---|---|
| Mar. 6, 1984 | [JP] | Japan | 59-41301 |
| Mar. 6, 1984 | [JP] | Japan | 59-41302 |
| Mar. 6, 1984 | [JP] | Japan | 59-41309 |
| Mar. 6, 1984 | [JP] | Japan | 59-41310 |

[51] Int. Cl.[5] ..... G03G 9/08

[52] U.S. Cl. ..... 430/110; 430/125

[58] Field of Search ..... 430/110, 125

[56] References Cited

U.S. PATENT DOCUMENTS

| | | | |
|---|---|---|---|
| 4,002,570 | 1/1977 | Lindblad | 430/110 |
| 4,254,204 | 3/1981 | Kato et al. | 430/106.6 X |
| 4,395,485 | 7/1983 | Kashiwagi et al. | 430/110 X |

*Primary Examiner*—J. David Welsh

*Attorney, Agent, or Firm*—Sughrue, Mion, Zinn, Macpeak & Seas

[57] ABSTRACT

A developer for an electrostatic latent image is disclosed, which comprises a toner powder and a fine powder of an acrylic homopolymer or copolymer having an average particle size smaller than that of the toner powder. The developer can be easily cleaned off without causing damage to a latent image-forming member.

18 Claims, No Drawings

ELECTROPHOTOGRAPHIC DEVELOPER COMPRISING TONER PARTICLES AND ACRYLIC POLYMER FINE PARTICLES

BACKGROUND OF THE INVENTION

The present invention relates to a developer, and more particularly, to a developer designed to experience minimum deterioration in its characteristics.

The electrostatic latent image formed in electrophotography or electrostatic recording can be made visible, or developed, by a variety of techniques. In one method, a developer made of a mixture of toner and carrier is used and the toner particles that are charged by triboelectrification upon mixing with carrier beads are attracted to oppositely charged sites on the photoreceptor or electrostatic recording element so as to produce a visible toner image. This toner image is transferred to a receiving sheet and fixed to reproduce a copy of the original. Because of incomplete transfer to the receiving paper, a toner image remains on the photoreceptor or electrostatic recording element, and therefore it must be cleaned before another copying cycle is started. This residual toner image is conventionally wiped off with a blade, brush (U.S. Pat. No. 2,832,977) or web (U.S. Pat. No. 3,186,838). As the copying cycle is repeated several thousand to several tens of thousand times, a gradual buildup of the residual toner occurs on the surface of the photoreceptor or electrostatic recording element in spite of the cleaning step. In order to avoid this insufficient cleaning or "toner filming", methods of mixing an additive with the developer composition have been proposed in British Patent No. 1,233,869, Japanese Patent Publication No. 1130/76, Japanese Patent Application (OPI) Nos. 120631/75 and 84741/77 (the term "OPI" as used herein refers to a "published unexamined Japanese patent application"). The additives proposed are organic polymers having low surface energy such as polytetrafluoroethylene and polyvinylidene fluoride (British Patent No. 1,233,869), non-clinging polymers whose static propensity is smaller than that of sulfur (Japanese Patent Publication No. 1130/76), a mixture of such non-clinging polymer and an abrasive such as colloidal silica (Japanese Patent Application (OPI) No. 120631/75), and polystyrene particles (Japanese Patent Application (OPI) No. 84741/77). These materials either reduce the sticking of the toner to the photoreceptor or electrostatic recording element or polish away the residual toner particles and hence are effective to some extent in preventing insufficient cleaning or toner filming. However, the toner in the developer containing such additives is not as effectively charged by triboelectrification as in the developer containing no such additives. This reduces the useful life of the developer and requires its frequent change. As the number of copying cycles exceeds 10,000–20,000, either a decreased image density or an increased fog occurs to such an extent that no further copying is possible. This phenomenon is particularly conspicuous in a hot and humid environment. The amount of static charge on the toner that has been used for reproducing 10,000–20,000 copies is about 30 to 40% smaller than the initial value. Since the photoreceptor in this stage is free from the "toner filming", the decreased image density or increased fog is believed to have resulted from the decreased ability of the developer to charge the toner particles by triboelectrification.

SUMMARY OF THE INVENTION

An object of the present invention, therefore, is to provide a developer that does not cause insufficient cleaning or toner filming on the photoreceptor or electrostatic recording element, while preventing the occurrence of a decreased image density or increased fog.

As a result of various studies made to attain this object, the present inventors have found that very good results can be achieved by using a developer comprising toner particles and fine particles of an acrylic polymer having an average size smaller than that of these toner particles. The present invention has been accomplished on the basis of this finding. The developer in accordance with the present invention can be completely cleaned off without causing damage to the latent image-forming member and without presenting any adverse effects on the developer such as its deterioration and shortened service life.

DETAILED DESCRIPTION OF THE INVENTION

The fine particles of an acrylic polymer used in the present invention that have an average size smaller than that of the toner particles may be prepared by a variety of techniques. For example, they may be directly obtained by emulsion polymerization, soap-free emulsion polymerization or suspension polymerization. Alternatively, a polymer obtained by one of these methods or by solution polymerization or bulk polymerization may be dissolved in a solvent and subsequently reduced into particles by spray-drying or mechanical grinding techniques.

The molecular weight of the acrylic polymer used in a fine particulate form in the present invention is not limited to any particular value and a wide range of molecular weights may be employed to the extent that they do not depart from the spirit and scope of the invention. The generally used range is from 10,000 to 300,000 in terms of the weight average molecular weight.

The acrylic polymer desirably has a glass transition point not lower than room temperature. However, polymers having glass transition points lower than room temperature may be employed on the condition that the toner flowability or its antiblocking properties are not impaired.

The acrylic polymer used in the present invention is selected from either homopolymers or copolymers of acrylates or methacrylates. Illustrative monomers that make up such (meth)acrylic polymers are esters of acrylic acid or methacrylic acid with alcohols such as alkyl alcohols, halogenated alkyl alcohols, alkoxyalkyl alcohols, aralkyl alcohols and alkenyl alcohols. Exemplary alcohols are listed below:

alkyl alcohols such as methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol and hexadecyl alcohol; halogenated alkyl alcohols wherein part of such alkyl alcohols is halogenated; alkoxyalkyl alcohols such as methoxyethyl alcohol, ethoxyethyl alcohol, ethoxyethoxyethyl alcohol, methoxypropyl alcohol and ethoxypropyl alcohol; aralkyl alcohols such as benzyl alcohol, phenylethyl alcohol, and phenylpropyl alcohol;

and alkenyl alcohols such as allyl alcohol and crotonyl alcohol.

These acrylic monomers may be used either alone or in combination with themselves. If necessary, they may be combined with one or more other copolymerizable monomers. In this latter case, the acrylic monomers account for at least 25 wt %, preferably at least 50 wt %, more preferably 70 wt % or more, of the total monomers. Examples of the copolymerizable monomers that may be used with the acrylic monomers are listed below:

styrene; alkylstyrenes such as methylstyrene, dimethylstyrene, trimethylstyrene, ethylstyrene, diethylstyrene, triethylstyrene, propylstyrene, butylstyrene, hexylstyrene, heptylstyrene and octylstyrene; halogenated styrenes such as fluorostyrene, chlorostyrene, bromostyrene, dibromostyrene and iodostyrene; as well as nitrostyrene, acetylstyrene and methoxystyrene.

Polymerizable unsaturated carboxylic acids may also be used, and they include addition-polymerizable unsaturated aliphatic monocarboxylic acids such as acrylic acid, methacrylic acid, α-ethylacrylic acid, crotonic acid, α-methylcrotonic acid, α-ethylcrotonic acid, isocrotonic acid, tiglic acid, and ungulinic acid; as well as addition-polymerizable unsaturated aliphatic dicarboxylic acids such as maleic acid, fumaric acid, itaconic acid, citraconic acid, mesaconic acid, glutaconic acid and dihydromuconic acid.

These carboxylic acids may be used in the form of metal salts. The formation of such metal salts may be effected after the completion of polymerization. The addition-polymerizable unsaturated carboxylic acids may also be esterified with alcohols such as alkyl alcohols, halogenated alkyl alcohols, alkoxyalkyl alcohols, aralkyl alcohols and alkenyl alcohols. Other usable monomers include amides and nitriles derived from such addition-polymerizable unsaturated carboxylic acids; aliphatic monoolefins such as ethylene, propylene, butene and isobutylene; halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride and vinylidene fluoride; and conjugated diene type aliphatic diolefins such as 1,3-butadiene, 1,3-pentadiene, 2-methyl-1,3-butadiene, 2,3-dimethyl-1,3-butadiene, 2,4-hexadiene and 3-methyl-2,4-hexadiene. Vinyl acetates, vinyl ethers, and nitrogen-containing vinyl compounds such as vinylcarbazole, vinylpyridine and vinylpyrrolidone may also be used.

Particularly preferred acrylic monomers are methyl acrylate, ethyl acrylate, propyl acrylate, butyl acrylate, methyl methacrylate, ethyl methacrylate, propyl methacrylate and butyl methacrylate. If copolymers are desired, such acrylic monomers may be combined either with themselves or with styrene monomers or vinylpyridine.

The fine particles of the acrylic polymer shown above may be irregular shapes or any other forms such as spherical, tabular or granular, but substantially round particles are preferred.

Such fine particles are incorporated in the developer by various techniques. For example, they are first blended with toner particles or carrier particles, and the mixture is then incorporated in the developer. Alternatively, the fine particles of the acrylic polymer may be directly blended in the developer.

The fine particles of one acrylic polymer may be used in combination with those of another acrylic polymer. If desired, other additives may also be used in combination with the fine particles of the present invention.

The fine particles according to the present invention must have an average size smaller than that of the toner particles. Particularly good results are obtained by particles each having a size in the range of 0.05 to 5 μm, preferably 0.1 to 2 μm. More preferably, almost all of the particles should have a size between 0.1 and 0.5 μm.

The fine particles according to the present invention may be used in an amount of 0.01 to 10 wt % of the toner. Better results are obtained by using the particles in an amount of 0.05 to 2.0 wt % of the toner.

The developer of the present invention is prepared by blending the fine particles of an acrylic polymer with known toners. The binder resin used in the toner is selected from homopolymers or copolymers of the following illustrative monomers: styrenes such as styrene, chlorostyrene and vinylstyrene; monoolefins such as ethylene, propylene, butylene and isobutylene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Typical binder resins include polystyrene, styrene-alkyl acrylate copolymers, styrene-alkyl methacrylate copolymers, styrene-acrylonitrile copolymer, styrene-butadiene copolymer, styrene-maleic anhydride copolymer, polyethylene and polypropylene. Other materials suitable for use as the binder resin include polyesters, polyurethane, epoxy resins, silicone resins, polyamides, modified rosin, paraffin and waxes.

The toner also contains a colorant, and typical examples of the colorant include carbon black, Nigrosine dyes, Aniline Blue, Alcohoil Blue, Chrome Yellow, Ultramarine Blue, DuPont Oil Red, Quinoline Yellow, Methylene Blue chloride, Phthalocyanine Blue, Malachite Green oxalate, Lamp Black and Rose Bengal.

Needless to say, the binder resin and colorant that can be incorporated in the toner in accordance with the present invention are not limited to the particular examples shown above.

Magnetic toners encapsulating magnetic materials may also be used.

The toner particles in accordance with the present invention generally have an average size smaller than about 30 μm, preferably between 3 and 20 μm.

The developer that has these additives incorporated therein in accordance with the present invention may be of the two-component type (carrier and toner) or of the single-component type that contains no carrier, with the two-component developer, carrier particles having an average size which is either comparable to the toner particle size or up to 500 μm. Any of the known carrier materials may be used, such as the powders of iron, nickel, cobalt, iron oxide, carbonyl iron, ferrite, glass beads, particulate silicone, and resins having magnetic particles dispersed therein.

These particles may be covered with coating agents such as fluoroplastics (fluorine-containing resins), acrylic resins and silicone resins. Illustrative acrylic resins are homopolymers or copolymers containing acrylic acid esters or methacrylic acid esters as the monomeric component. The monomers may be selected from the acrylic monomers described in connection with the fine particles of the acrylic polymer especially used in the present invention as the material to be combined with the toner particles. The comonomers may also be selected from among the copolymerizable monomers already described above, such as styrene monomers, polymerizable unsaturated carboxylic acids and metal salts or esters thereof, amides and nitriles derived from addition-polymerizable unsaturated carboxylic acids, aliphatic monoolefins, halogenated aliphatic olefins, and conjugated dicne type aliphatic diolefins. Other suitable monomers include vinyl acetates and vinyl ethers; nitrogencontaining vinyl compounds such as 2-vinylpyridine, 4-vinylpyridine, 2-vinyl-6-methylpyridine, 2-vinyl-5-methylpyridine, 4-butenylpyridine, 4-pentylpyridine, N-vinylpiperidine, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperidone and N-vinylcarbazole; and vinyl silane compounds such as vinyl trimethoxysilane and vinyl triethoxysilane.

Silicone resins are a group of cross-linked or uncross-linked polymers such as polymethylsiloxane, polymethylphenylsiloxane and polyphenylsiloxane. In the context of the present invention, the silicone resins include all types of polymers having a siloxane bond in the main chain. Therefore, modified products such as acryl-modified silicone resins and epoxymodified silicone resins may also be used in the present invention.

If carrier particles are covered with these resins, their coverage generally ranges from 0.1 to 10 wt %, preferably from 0.5 to 3 wt %, of the carrier particles. The indicated ranges are selected in order to provide a durable resin coat that ensures good triboelectrification without causing the adhesion of toner particles to the carrier. Particularly preferred embodiments of the developer in accordance with the present invention are listed below:

1. A developer comprising a toner having at least one binder resin selected from styrene resins, acrylic resins and polyester resins, and the fine particles of an acrylic resin containing at least one monomer selected from the group consisting of methyl acrylate, ethyl acrylate, propyl acrylate, butyl acrylate, methyl methacrylate, ethyl methacrylate, propyl methacrylate and butyl methacrylate;

2. A developer comprising a coated carrier which has a core material covered with at least one resin selected from fluoroplastics, acrylic resins and silicone resins, a toner, and the fine particles of an acrylic resin containing at least one monomer selected from the group consisting of methyl acrylate, ethyl acrylate, propyl acrylate, butyl acrylate, methyl methacrylate, ethyl methacrylate, propyl methacrylate and butyl methacrylate; and 3. A developer comprising a coated carrier which has a core material covered with at least one resin selected from fluoroplastics, acrylic resins and silicone resins, a toner having at least one binder resin selected from styrene resins, acrylic resins and polyester resins, and the fine particles of an acrylic resin containing at least one monomer selected from the group consisting of methyl acrylate, ethyl acrylate, propyl acrylate, butyl acrylate, methyl methacrylate, ethyl methacrylate, propyl methacrylate and butyl methacrylate.

The developer of the present invention may be employed to develop an electrostatic latent image that has been formed on a photoreceptor or an electrostatic recording element. The electrostatic latent image is formed electrophotographically on a photoreceptor made of an inorganic photoconductive material such as selenium, zinc oxide, cadmium sulfide or amorphous silicon, or an organic photoconductive material such as a phthalocyanine dye or bisazo dye. This photoreceptor may be coated with a protective layer or an insulator layer. Alternatively, the latent image may be formed by, for example, needle electrodes on an electrostatic recording element having a dielectric such as polyethylene terephthalate. The latent image is subjected to the magnetic brush development, cascade development or touchdown development so as to produce a toner image by the developer of the present invention which is attracted to selected sites on the photoreceptor or electrostatic recording element. The toner image is then transferred to a receiving sheet, usually paper, and is fixed to provide a reproduced copy. The residual toner particles are wiped off the surface of the photoreceptor or electrostatic recording element by a suitable cleaning method using a blade, brush, web or roll.

The developer of the present invention provides the following advantages.

1. Insufficient cleaning can be prevented.

The residual toner particles sticking to the surface of a photoreceptor or electrostatic recording element can be completely cleaned even after as many as fifty thousand copies have been reproduced. A developer using known additives ensures satisfactory cleaning of the residual toner if the number of copies reproduced is small. However, the removability of toner particles is gradually decreased, and after more than 20,000 to 30,000 copies have been reproduced, an excessive buildup of the residual toner causes overlapping images or black stripes in the copy reproduced in the subsequent cycle.

2. The developer has a prolonged life.

The performance of the developers, particularly their ability to be charged by triboelectrification, is inevitably decreased as the number of copies reproduced is increased. This tendency is especially great in a developer using prior art additives. However, the developer of the present invention is less likely to suffer the decrease in its developing capability, and at least fifty thousand copies of an original having an image density of 0.7 which has the greatest possibility of density drop can be reproduced with satisfactory results, and the decrease in density of the copied image is substantially zero. This advantage is not lost even under hot and humid conditions.

3. The developer is the least likely to cause damage to the photoreceptor or electrostatic recording element, and is substantially free from the chance of toner filming.

The advantages of the present invention will be apparent from the following Examples and Comparative Examples, which should be no means be construed as limiting the scope of the invention. In the Examples and Comparative Examples, all parts are by weight.

EXAMPLE 1

A 1,000 ml four-necked flask equipped with a stirrer, a thermometer, a nitrogen supply pipe and a reflux condenser was charged with 100 parts of methyl methacrylate and 300 parts of distilled water. As an initiator, a redox catalyst composed of potassium persulfate and sodium thiosulfate was introduced in an amount of $5\times10^{-3}$ mol/1,000 ml. Reaction was conducted at 60° C. for 2 hours under a nitrogen stream. The reaction mixture was subsequently cooled to 20° C. and passed through an ultrafiltration apparatus and a hot-air drier so as to produce fine particles having an average size of 0.7 μm.

EXAMPLE 2

An apparatus which was the same as used in Example 1 was charged with 80 parts of methyl methacrylate, 20 parts of butyl methacrylate, 200 parts of distilled water, 0.6 part of potassium persulfate, 4 parts of polyoxyethylenenonyl phenol, and 1 part of sodium laurylsulfate, and the mixture was subjected to emulsion polymerization at 80° C. for 4 hours under a nitrogen stream. After completion of the polymerization, the reaction mixture was cooled to 20° C., and passed through an ultrafiltration apparatus and a hot-air drier so as to produce fine particles having an average size of 0.1 μm.

EXAMPLE 3

Toner particles with an average size of 12 μm were prepared. They contained a styrene/n-butyl methacrylate copolymer as a binder resin and used carbon black as a colorant. 100 parts of this toner was blended in a Henschel mixer with 0.5 part of the fine particles prepared in Example 1, thereby producing a toner composition in accordance with the present invention.

EXAMPLE 4

100 parts of the same toner as used in Example 3 and 0.5 part of the fine particles prepared in Example 2 were mixed by the same method as used in Example 3, thereby producing a toner composition in accordance with the present invention.

COMPARATIVE EXAMPLE 1

100 parts of the same toner as used in Example 3 and 0.5 part of the fine particles of polystyrene (average size: 0.4 μm) were mixed by the same method as used in Example 3, thereby preparing a toner composition.

COMPARATIVE EXAMPLE 2

100 parts of the same toner as used in Example 3 and 0.5 part of zinc palmitate (average size: 0.7 μm) were mixed by the same method as used in Example 3, thereby preparing another toner composition.

COMPARATIVE EXAMPLE 3

The toner used in Example 3 was immediately employed as a toner (i.e., with no additives).

EXPERIMENT

Spherical iron oxide particles (average size: 100 μm) were covered with 0.6 wt %, based on the weight of the iron oxide particles, of styrene-methyl methacrylate copolymer so as to prepare carrier particles. Samples of these carrier particles were mixed with the toner compositions of Examples 3 and 4, as well as Comparative Examples 1 to 3, so as to provide developer samples. A test for reproducing 100,000 copies was performed with a photocopier Model 4370 of Fuji Xerox Co., Ltd. using the respective developer samples. The reproduction cycle consisted of the following steps: forming a latent electrostatic image on the photoreceptor; forming a toner image by performing the magnetic brush development using the developer sample; transferring the toner image to a receiving sheet; and cleaning the residual toner from the photoreceptor with a blade. The results of the copying test are summarized in the following Table 1, which clearly shows the superior properties of the developers prepared in accordance with the present invention.

TABLE 1

| | Factors | | | | | |
|---|---|---|---|---|---|---|
| | | | | Static Amount (μC/g) | | |
| Developer Sample | Poor Cleaning | Flaws on Photoreceptor | Toner Filming | Initial | After Reproduction of 50,000 Copies | Developer Life* |
| Example 3 | None before 50,000 copies were reproduced | None | None | 14 | 14 | >50,000 |
| Example 4 | None before 50,000 copies were reproduced | " | " | 18 | 13 | " |
| Comparative Example 1 | Three cases during the reproduction of 50,000 copies | " | " | 17 | 4 | 15,000 |
| Comparative Example 2 | Nine cases during the reproduction of 50,000 copies | " | Occured | 17 | 33 | 35,000 |
| Comparative Example 3 | More than 50 cases during the reproduction of 50,000 copies | Extensive (three replacements of the photoreceptor were necessary) | " | 12 | 8 | 40,000 |

*The life of the developer is indicated in terms of the number of copies of an original with an image density of 0.7 that could be reproduced at an image density of at least 0.7 and a fog density of not higher than 0.02.

EXAMPLE 5

A 1,000 ml four-necked flask equipped with a stirrer, a thermometer, a nitrogen supply pipe and a reflux condenser was charged with 80 parts of methyl methacrylate, 20 parts of styrene and 300 parts of distilled water. As an initiator, a redox catalyst composed of potassium persulfate and sodium thiosulfate was introduced in an amount of $5\times10^{-3}$ mol/1,000 ml. Reaction was conducted at 60° C. for 2 hours under a nitrogen stream. The reaction mixture was subsequently cooled to 20° C. and passed through an ultrafiltration apparatus and a hot-air drier so as to produce fine particles having an average size of 0.9 μm.

EXAMPLE 6

An apparatus which was the same as used in Example 5 was charged with 5 parts of methyl methacrylate, 30 parts of styrene, 280 parts of distilled water and 0.3 part of potassium persulfate, and the mixture was subjected to polymerization at 70° C. for 24 hours under a nitrogen stream. After completion of the polymerization, the reaction mixture was cooled to 20° C., and passed through an ultrafiltration apparatus and a hotair drier so as to produce fine particles having an average size of 0.5 μm.

EXAMPLE 7

Toner particles with an average size of 12 μm were prepared. They contained a styrene/n-butyl methacrylate copolymer as a binder resin and used carbon black as a colorant. 100 parts of this toner was blended in a Henschel mixer with 0.5 part of the fine particles prepared in Example 5, thereby producing a toner composition in accordance with the present invention.

EXAMPLE 8

100 parts of the same toner as used in Example 7 and 0.5 part of the fine particles prepared in Example 6 were mixed by the same method as used in Example 7, thereby producing a toner composition in accordance with the present invention.

COMPARATIVE EXAMPLE 4

100 parts of the same toner as used in Example 7 and 0.5 part of the fine particles of polyvinylidene fluoride (average size: 0.2 μm) were mixed by the same method as used in Example 7, thereby producing a toner composition.

The toner compositions of Examples 7 and 8, as well as Comparative Example 4 were processed as in the Experiment shown above, so as to provide developer samples. Using these samples, a reproduction test was conducted in the same manner as already described. The results are summarized in Table 2.

| Preparation Example 5 (Preparation of Resin E) | |
|---|---|
| Polyoxypropylene(2,2)-2,2-bis(4-hydroxyphenyl) propane | 770 g |
| Polyoxyethylene(2,2)-2,2-bis(4-hydroxyphenyl) propane | 720 g |
| Terephthalic acid | 690 g |
| Tri-2-ethylhexyl 1,2,4-benzene tricarboxylate | 120 g |

EXAMPLE 9

100 parts of toner particles with an average size of 12 μm that consisted of a styrene/n-butyl acrylate copolymer and carbon black was blended in a Henschel mixer with 0.5 part of the fine particles of a methyl methacrylate/styrene/acrylic acid (weight ratio=80/19/1) copolymer that had been obtained by soap-free emulsion polymerization and which had an average size of 0.3 μm.

Spherical iron oxide particles having an average size of 80 μm were coated with 0.9 wt %, based on the weight of the iron oxide particles, of a methyl methacrylate/butyl acrylate/2-vinylpyridine (weight ratio=90/9/1) copolymer by a fluidized bed coating apparatus so as to provide coated carrier particles.

3 parts of the carrier particles was mixed with 100 parts of the previously prepared toner composition so as to provide a developer in accordance with the present invention.

EXAMPLE 10

100 parts of toner particles (average size: 11 μm) consisting of a polyester resin (synthesized from bisphenol A ethylene oxide adduct, glycerin and fumaric acid) was mixed as in Example 9 with 0.2 part of the fine copolymer particles prepared as in Example 9. 100 parts of the resulting toner composition was mixed with 3 parts of the carrier which was the same as prepared in Example 9, thereby producing a developer in accordance with the present invention.

EXPERIMENT

A test for reproducing 100,000 copies was conducted with a photocopier (Model 4370 of Fuji Xerox Co., Ltd.) using the developer samples prepared in Examples 9 and 10. The results of the copying test are summarized in the following Table 3, from which one can clearly see the superior properties of the developers prepared in accordance with the present invention.

TABLE 3

| | Factors | | | | | |
|---|---|---|---|---|---|---|
| | | | | Static Amount (μC/g) | | |
| Developer Sample | Poor Cleaning | Flaws on Photoreceptor | Toner Filming | Initial | After Reproduction of 100,000 Copies | Developer Life* |
| Example 9 | None before 100,000 copies were reproduced | None | None | 16 | 21 | >100,000 |
| Example 10 | None before 100,000 copies were reproduced | " | " | 23 | 14 | " |

*See Table 1.

EXAMPLE 11

100 parts of toner particles (average size: 12 μm) that consisted of a styrene/n-butyl acrylate copolymer, azo type chromium complex salt dye and carbon black was blended in a Henschel mixer with 0.8 part of the fine particles of a methyl methacrylate/4-vinylpyridine (weight ratio=97/3) copolymer that had been obtained by soap-free emulsion polymerization and which had an average size of 0.2 μm.

Spherical iron oxide particles having an average size of 120 μm were coated with 0.5 wt %, based on the weight of the iron oxide particles, of a polymethylphenyl siloxane resin (KR-295, product of Shinetsu Chemical Industry Co., Ltd.) by a fluidized bed coating apparatus so as to provide coated carrier particles.

3 parts of the carrier particles was mixed with 100 parts of the previously prepared toner composition so as to provide a developer in accordance with the present invention.

EXAMPLE 12

100 parts of toner particles that were prepared as in Example 11 were mixed as in Example 11 with 1.0 part of the fine polymethyl methacrylate particles (average size: 0.3 μm) that were prepared by soap-free emulsion polymerization. 100 parts of the resulting toner composition was mixed with 3 parts of the carrier which was the same as prepared in Example 11, thereby producing a developer in accordance with the present invention.

EXPERIMENT

A test for reproducing 100,000 copies was conducted with a photocopier (Model 4370 of Fuji Xerox Co., Ltd.) using the developer samples prepared in Examples 11 and 12. The results of the copying test are summarized in the following Table 4, from which one can clearly see the superior properties of the developers prepared in accordance with the present invention.

TABLE 4

| | Factors | | | | | |
|---|---|---|---|---|---|---|
| | | | | Static Amount (μC/g) | | |
| Developer Sample | Poor Cleaning | Flaws on Photoreceptor | Toner Filming | Initial | After Reproduction of 100,000 Copies | Developer Life* |
| Example 11 | None before 100,000 copies were reproduced | None | None | 13 | 17 | >100,000 |
| Example 12 | None before 100,000 copies were reproduced | " | " | 17 | 18 | " |

*See Table 1.

While the invention has been described in detail and with reference to specific embodiments thereof, it will be apparent to one skilled in the art that various changes and modifications can be made therein without departing from the spirit and scope thereof.

What is claimed is:

1. A developer for use in electrophotography consisting essentially of a toner powder which contains a colorant and 0.01 to 10 wt % based on the wt % of the toner of a fine powder consisting essentially of an acrylic homopolymer or copolymer having an average particle size smaller than that of the toner powder.

2. A developer for use in electrophotography consisting essentially of carrier particles, a toner powder which contains a colorant and 0.01 to 10 wt % based on the wt % of the toner of a fine powder consisting essentially of an acrylic homopolymer or copolymer having an average particle size smaller than that of the toner powder.

3. A developer according to claim 1 or 2, wherein said fine powder comprises particles ranging from 0.05 to 5 μm in size.

4. A developer according to claim 1 or 2, wherein said fine powder comprises particles ranging from 0.1 to 2 μm in size.

5. A developer according to claim 1 or 2, wherein said fine powder comprises substantially spherical particles.

6. A developer according to claim 1 or 2, wherein said acrylic homopolymer or copolymer contains an acrylic or methacrylic acid ester as a monomer component.

7. A developer according to claim 1 or 2, wherein said acrylic homopolymer or copolymer has a weight average molecular weight of from 10,000 to 300,000.

8. A developer according to claim 2, wherein said carrier particles each consists of a core material and a surface coat.

9. A developer according to claim 8, wherein the surface coat on each carrier particle is made of at least one resin selected from the group consisting of fluoroplastics, acrylic resins and silicone resins.

10. A developer according to claim 8, wherein the surface coat on each carrier particle is made of an acrylic resin containing an acrylic or methacrylic acid ester as a monomer component.

11. A developer according to claim 8, wherein the surface coat on each carrier particle is made of a silicone resin containing a siloxane bond in the main chain.

12. A developer according to claim 8, wherein the surface coat on each carrier particle is made of a silicone resin selected from the group consisting of polymethyl siloxane, polymethylphenyl siloxane, polyphenyl siloxane, acryl-modified silicone resin and epoxy-modified silicone resin.

13. A developer according to claim 1 or 2, wherein said developer contains a colorant selected from the group consisting of carbon black, Nigrosine dyes, Aniline Blue, Alcohoil Blue, Chrome Yellow, Ultramarine Blue, Dupont Oil Red, Quinoline Yellow, Methylene Blue Chloride, Phthalocyanine Blue, Malachite Green oxalate, Lamp Black and Rose Bengal.

14. A developer according to claim 1 or 2, wherein said toner powder has an average particle size of 3 to 20 μm.

15. A developer according to claims 1 or 2, consisting essentially of said toner powder and said fine powder.

16. A developer accordingly to claims 1 or 2, consisting of said toner powder and said fine powder.

17. A developer for use in electrophotography consisting essentially of a toner powder which contains a colorant and 0.01 to 10 wt % based on the wt % of the toner of a fine powder consisting of an acrylic homopolymer or copolymer having an average particle size smaller than that of the toner powder.

18. A developer for use in electrophotography consisting essentially of carrier particles, a toner powder which contains a colorant and 0.01 to 10 wt % based on the wt % of the toner powder of a fine powder consisting of an acrylic homopolymer or copolymer having an average particle size smaller than that of the toner powder.

* * * * *